US007437332B2

(12) United States Patent
Jacobson et al.

(10) Patent No.: US 7,437,332 B2
(45) Date of Patent: Oct. 14, 2008

(54) MAILING MACHINE INCLUDING METHODS AND SYSTEMS TO REDUCE WEIGHING ERRORS WHEN OPERATING IN A DIFFERENTIAL WEIGHING MODE

(75) Inventors: Gary S. Jacobson, Norwalk, CT (US); Wesley A. Kirschner, Hamden, CT (US); Joseph M. Mozdzer, Shelton, CT (US); Konstantin G. Kodonas, Norwalk, CT (US); Joseph P. Tokarski, Prospect, CT (US)

(73) Assignee: Pitney Bowes Inc., Stamford, CT (US)

( * ) Notice: Subject to any disclaimer, the term of this patent is extended or adjusted under 35 U.S.C. 154(b) by 799 days.

(21) Appl. No.: 10/857,993

(22) Filed: Jun. 1, 2004

(65) Prior Publication Data

US 2005/0278264 A1 Dec. 15, 2005

(51) Int. Cl.
*G07B 17/02* (2006.01)

(52) U.S. Cl. ..... 705/407

(58) Field of Classification Search ..... 705/407
See application file for complete search history.

(56) References Cited

U.S. PATENT DOCUMENTS 5,001,648 A 3/1991 Baker
5,498,114 A 3/1996 Gregoire et al. ..... 414/21
2003/0204477 A1* 10/2003 McNett ..... 705/406

FOREIGN PATENT DOCUMENTS

DE 40 15 852 A1 11/1999

OTHER PUBLICATIONS

Hudson, Marion, "Product Focus: Mailing Systems & Addressing Software," Office Solutions, Mr. Airy, May/Jun. 2003, vol. 20, Iss. 3, p. 33.*

* cited by examiner

*Primary Examiner*—John W Hayes
*Assistant Examiner*—Nathan Erb
(74) *Attorney, Agent, or Firm*—Brian A. Lemm; Angelo N. Chaclas

(57) ABSTRACT

A mailing machine is provided that, when operating in a differential weighing mode, can detect if a user has replaced one or more mail pieces that may have been inadvertently removed at the same time back onto the scale. If the mailing machine detects such replacement within a predetermined time period after the scale has stabilized, the weight calculated for the mail piece can be reduced by the amount added back to the scale, or, alternatively, the user could be requested to confirm that multiple pieces were inadvertently removed from the scale at the same time, the user is trying to correct that error, and a new weight is to be determined.

21 Claims, 5 Drawing Sheets

MAILING MACHINE INCLUDING METHODS AND SYSTEMS TO REDUCE WEIGHING ERRORS WHEN OPERATING IN A DIFFERENTIAL WEIGHING MODE

FIELD OF THE INVENTION

The invention disclosed herein relates generally to mail processing systems, and more particularly to a manually fed mailing machine incorporating systems and methods to reduce feeding and weighing errors when operating in a differential weighing mode.

BACKGROUND OF THE INVENTION

Mail processing equipment, such as, for example, a mailing machine, often includes different modules that automate the process of producing mail pieces. The typical mailing machine includes a variety of different modules or sub-systems each of which performs a different task on the mail piece. The mail piece is conveyed downstream utilizing a transport mechanism, such as rollers or a belt, to each of the modules. Such modules could include, for example, a singulating module, i.e., separating a stack of mail pieces such that the mail pieces are conveyed one at a time along the transport path, a moistening/sealing module, i.e., wetting and closing the glued flap of an envelope, and a metering module, i.e., applying evidence of postage to the mail piece. The exact configuration of the mailing machine is, of course, particular to the needs of the user.

One of the factors that determines the cost for shipping a mail piece to a destination is the weight of the mail piece. A mail piece could be, for example, an envelope, postcard, magazine, package, etc. The mailing machine will be provided with the weight of the mail piece, typically from an integral scale incorporated within the mail flow path, an external scale coupled to the mailing machine, or user input. Based on the weight of the mail piece, the postage rate and operator specified service option for a selected carrier, the mailing machine will determine the cost to deliver the mail piece to the destination. The mailing machine will then conduct an accounting procedure for the cost of shipping the mail piece and print an indicium evidencing payment of the postage. Mailing machines have traditionally been capable of printing postage indicia either directly on mail pieces, or on pieces of tape or a label, which are then attached to mail pieces.

For mailing systems that utilize an external platform scale, i.e., a scale that is independent and separate from the mail flow path, there are different methods that can be utilized for determining the weight of an item. In one method, referred to as single piece mode, the user places each mail piece onto the platform of the external scale, and the weight of the mail piece is provided by the scale to the controller of the mailing machine. The controller will calculate the cost for shipping the mail piece based on the weight of the mail piece provided by the scale. The user removes the mail piece from the scale and places it on the feed deck of the mailing machine base. Sensors detect the presence of the mail piece on the feed deck and the mail piece is automatically fed into the mailing machine for processing, or, alternatively, the user must press a start button for the mailing machine to transport the mail piece into the mail flow path. The user then repeats this procedure for each mail piece that the user desires to process.

Another method for determining the weight of a mail piece is referred to as a differential weighing method as disclosed in U.S. Pat. No. 5,001,648, which is hereby incorporated by reference. In accordance with the differential weighing method, a plurality of mail pieces are placed on an external scale coupled to a mailing machine and the collective weight of the mail pieces is registered. When the user removes a mail piece from the scale, the difference between the original collective weight of the mail pieces and the new collective weight of the mail pieces remaining on the scale is determined. The cost for shipping of the mail piece is calculated based on the determined differential weight. Sensors detect the presence of the mail piece on the feed deck and the mail piece is preferably automatically fed into the mailing machine for processing. The user then repeats this procedure for each mail piece that the user desires to process.

While conventional manual feed mailing machines generally work well utilizing the weighing methods as described above, there are some problems. For example, there are several ways in which mistakes made by the user in removing mail pieces from the scale and feeding the mail pieces into the mailing machine can result in the calculation and printing of incorrect postage for a mail piece. This is especially true if the mailing machine is being operated in a differential weighing mode and the user is attempting to process the mail pieces as quickly as possible. For example, the user may inadvertently remove two mail pieces at the same time. This would result in a single weight being calculated based on the combined weight of both of the removed mail pieces. If the user does not realize the mistake and places both of the removed mail pieces on the feed deck, only the first mail piece will be processed by the mailing machine, and an incorrect postage amount (which will be greater than necessary, thereby costing the user additional unnecessary postage fees), based on the weight of both mail pieces, will be printed on the mail piece. Since there will be no weight for the second mail piece, the postage for the second mail piece will not be calculated, and the second mail piece will not be fed into the mailing machine by the transport system. Thus, the second mail piece will simply sit on the feed deck of the mailing machine and no further operations will occur. The user may not be aware that two mail pieces were inadvertently removed from the scale together, and may believe that there is a problem with the sensors or feeding mechanism of the mailing machine. The user may be inclined to restart the entire system, which is time consuming, thereby decreasing the throughput of the mailing machine, or place a service call in the belief that the mailing machine is in need of repair. In either case, this can lead to general dissatisfaction with the mailing machine by the user.

Even if the user realizes that more than one mail piece was removed at the same time and attempts to replace one or more of the removed mail pieces back onto the scale such that only a single piece was actually removed, the problem may still not be corrected. For example, the inadvertently removed piece or pieces of mail may be added after the scale has stabilized and an incorrect weight reading, based on the weight of all of the removed mail pieces, has already been determined. The user will be unaware of the incorrect reading, which can result in either a loss of postage funds due to an incorrect amount of postage greater than required.

Another feeding and weighing error that can occur is if the scale has not stabilized sufficiently to provide a weight of the mail piece just removed before a subsequent mail piece is removed by the user. Such a situation could also result in a single weight being calculated based on the combined weight of both of the removed mail pieces, resulting in an incorrect postage value being printed on the first mail piece and the second mail piece not being processed by the mailing machine similarly as described above. Alternatively, this problem could result in the mailing machine being out of synchronization with the mail pieces. For example, the user may remove a third mail piece, and the mailing machine will use the weight of the third mail piece when processing the second mail piece.

Thus, there exists a need for a method and system that reduces feeding and weighing errors in a manually fed mailing machine.

SUMMARY OF THE INVENTION

The present invention alleviates the problems associated with the prior art and provides methods and systems that reduce errors in a manually fed mailing machine as described above, thereby allowing a very fast throughput to be achieved while maintaining mail piece integrity, i.e., associating each mail piece with the proper information for that mail piece.

In accordance with embodiments of the present invention, a mailing machine, when operating in a differential weighing mode, can detect if a user has replaced one or more mail pieces that may have been inadvertently removed at the same time back onto the scale. For example, if a user inadvertently removes more than one mail piece at a time from the scale, realizes the error and replaces one or more mail pieces back on the scale such that only a single piece has actually been removed, embodiments of the mailing machine of the present invention are provided with features to detect such replacement and confirm with the user that the user has actually tried to correct such an error. One embodiment includes determining if weight has been added back to the scale after an initial weight has stabilized within a predetermined time period, thereby indicating that the user may have placed a mail piece back on the scale. If weight has been added during the predetermined time period, the weight calculated for the mail piece can be reduced by the amount added back to the scale, or alternatively the user could be requested to confirm that multiple pieces were inadvertently removed from the scale at the same time and the user is trying to correct that error.

In accordance with other embodiments of the present invention, if the user does not realize the mistake and does not replace the inadvertently removed mail pieces back on the scale, a mailing machine is provided with sensors to detect the presence of multiple mail pieces on the feed deck without a corresponding weight. Thus, if a second mail piece is detected on the feed deck of the mailing machine and a corresponding weight for the second mail piece has not been received, a signal will be provided to the user indicating that the second mail piece must be placed back on the platform, and that the first mail piece that was just processed might have an incorrect postage amount based on the weight for both the first and second mail pieces.

In accordance with other embodiments of the present invention, when the scale platform has stabilized and a weight determined for a removed mail piece, a visual or audio signal is sent to the user indicating that the next piece can be removed from the scale platform. If the scale platform does not stabilize within a predetermined time period, a different visual or audio signal is provided to the user indicating that the scale has not stabilized, thereby alerting the user that there may be a problem with the processing of the mail piece and the user should take a corrective action to ensure the mail piece is properly weighed and therefore the postage is properly calculated.

Therefore, it should now be apparent that the invention substantially achieves all the above aspects and advantages. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION OF THE PRESENT INVENTION

Figure 1:
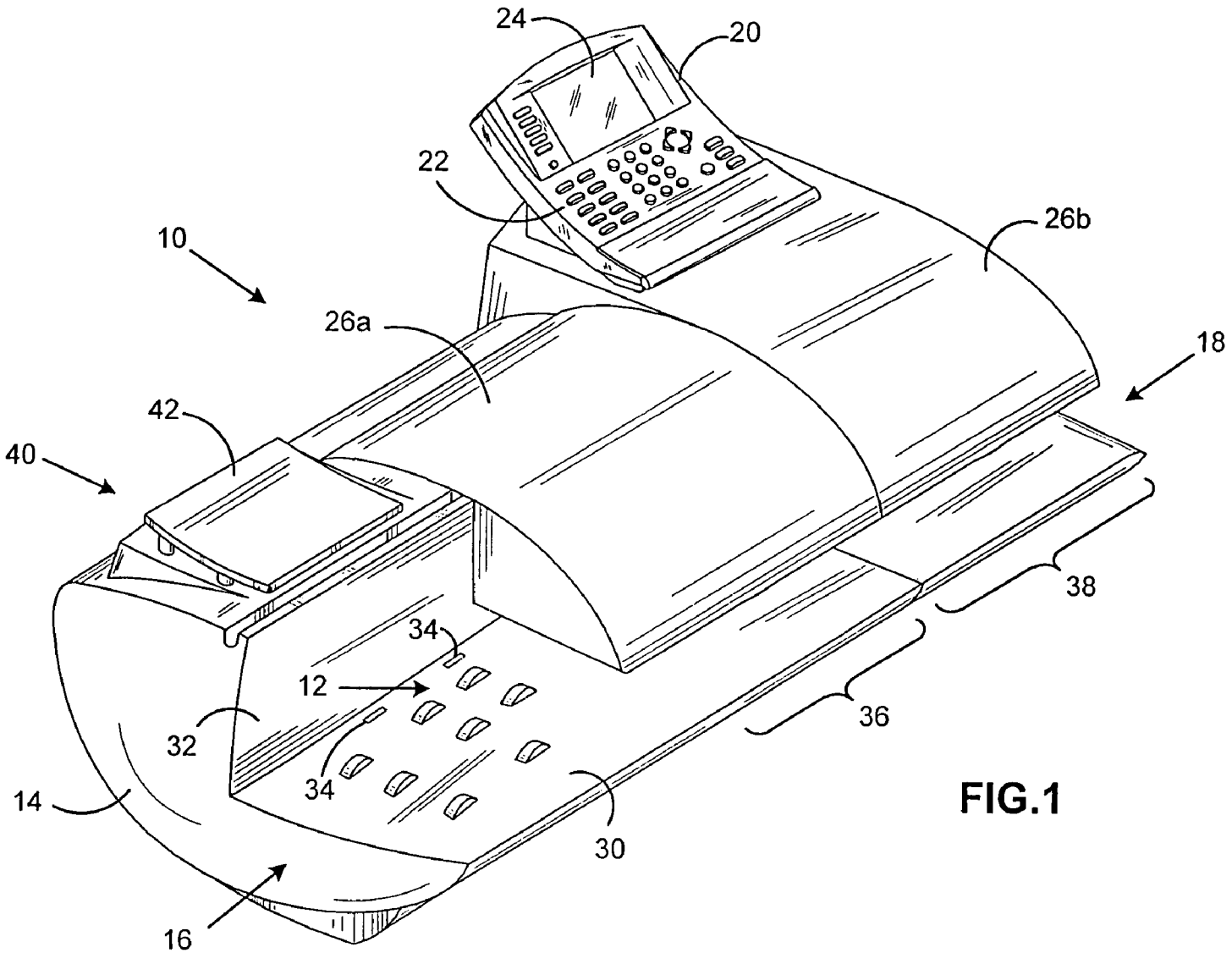
FIG. 1 illustrates a mailing machine having systems and methods for reducing feeding and weighing errors according to embodiments of the present invention.

In describing the present invention, reference is made to the drawings, wherein there is seen in FIG. 1 a mailing machine 10 that includes systems and methods for reducing feeding and weighing errors according to embodiments of the present invention. Mailing machine 10 comprises a base unit, designated generally by the reference numeral 14, the base unit 14 having a mail piece input end, designated generally by the reference numeral 16, and a mail piece output end, designated generally by the reference numeral 18. A control unit 20 is mounted on the base unit 14, and includes one or more input/output devices, such as, for example, a keyboard 22 and a display device 24. Control unit 20 preferably includes one or more controller units, such as, for example, a microprocessor, general or special purpose processor or the like, to control operation of the mailing machine 10. One or more cover members 26*a*, 26*b* are pivotally mounted on the base 14 so as to move from the closed position shown in FIG. 1 to an open position (not shown) to expose various operating components and parts for service and/or repair as needed.

The base unit 14 further includes a horizontal feed deck 30 which extends substantially from the input end 16 to the output end 18. A plurality of nudger rollers 12 are preferably mounted under the feed deck 30 and project upwardly through openings in the feed deck so that the periphery of the rollers 12 is slightly above the upper surface of the feed deck 30 and can exert a forward feeding force on a succession of mail pieces placed in the input end 16. One or more sensors 34, such as, for example, optical sensors, are located in the feed deck 30 to detect the presence of a mail piece on the feed deck 30. A registration wall 32 defines a mail piece registration surface substantially perpendicular to the feed deck 30 that extends substantially from the input end 16 to the output end 18. A scale 40, including a platter 42 (which may be removable), is preferably located near the input end 16, such as, for example, above and adjacent to the registration wall 32 as illustrated. Components of the weighing scale 40 other than the platter 42, including a load cell and related electronics, can be located within the base unit 14. Thus, while the scale 40 may be integral with the base unit 14, it is still considered an external platform scale as it is independent and separate from the mail flow path along the feed deck 30.

Alternatively, a separate external stand alone scale (not shown) may be coupled to the mailing machine 10 by any suitable communication link, such as, for example, a USB or RS232 interface.

The scale 40 can be operated by a user to weigh mail pieces utilizing either the single piece mode or differential weighing mode previously described. When the mail pieces are removed from the platter 42 of the scale 40, the user places the mail piece in the input end 16 where one or more of the sensors 34 detect the mail piece. Signals from the sensors 34 are sent to the control unit 20, which in response, will activate the nudger rollers 12 to feed the mail piece along the feed deck 30, with the top edge of the mail piece being registered against the registration wall 32. Alternatively, control unit 20 may require an input from the user, such as, for example, pressing a start button, in lieu of or in addition to the signal from sensors 34, before activating the nudger rollers 12. The mail pieces may be passed through one or more modules, such as, for example, a singulator module and a moistening/sealing module, as are well known. Each of these modules is located generally in the area indicated by reference numeral 36. The mail pieces are then passed to a metering/printing module located generally in the area indicated by reference numeral 38, where an indicium evidencing postage will be printed on the mail piece. Alternatively, if a mail piece is not fed through the mailing machine 10, the indicium may be printed on a tape or label that can be affixed to the mail piece.

Figure 2:
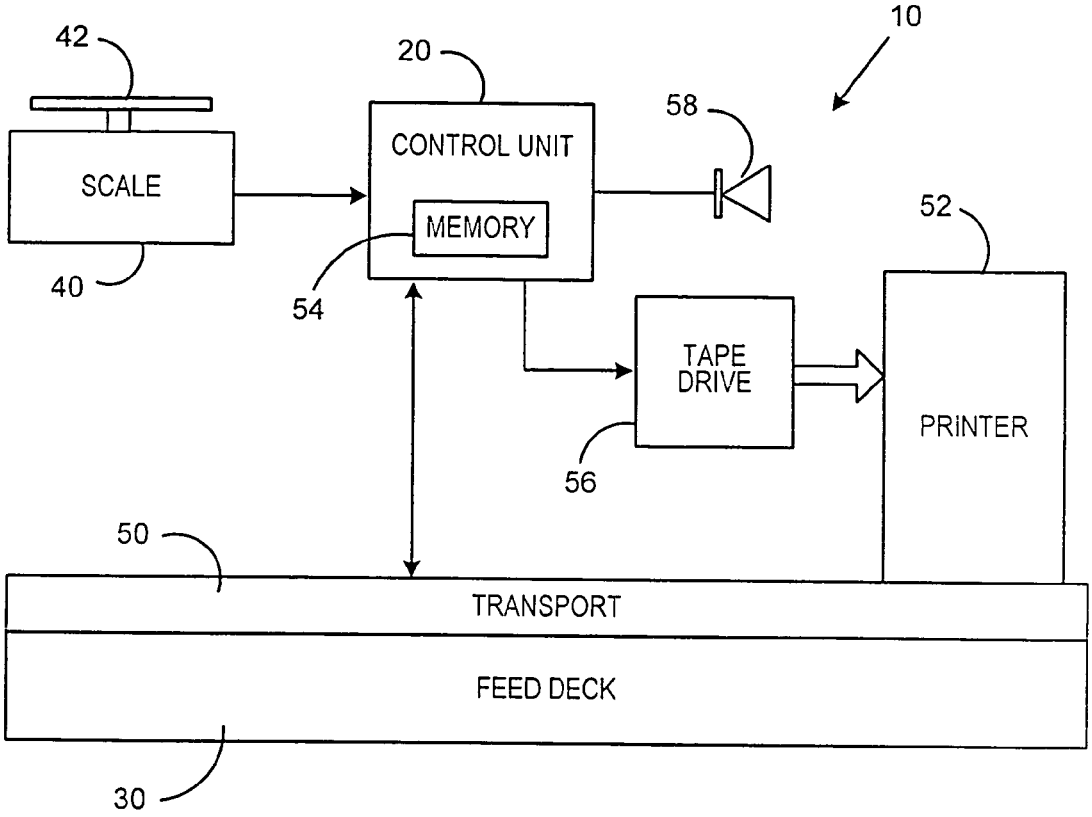
FIG. 2 illustrates in block diagram form portions of the mailing machine of FIG. 1.

FIG. 2 illustrates in block diagram form portions of the mailing machine 10 illustrated in FIG. 1. As illustrated in FIG. 2, a transport 50, including, for example, the nudger rollers 12 of FIG. 1, utilized to transport mail pieces along the feed deck 30 is coupled to the control unit 20 and transports mail pieces based on signals provided from the control unit 20. The transport 50 will transport the mail pieces through the modules of the mailing machine 10, including a printer 52, wherein printing can occur on each mail piece. The scale 40 is coupled to the control unit 20. Scale 40 can provide the weight of an object on the scale 40 to control unit 20, or could provide a representative signal to control unit 20 from which the control unit 20 will determine the weight of the object. The control unit 20 will determine the necessary postage costs for a mail piece, based at least in part on the weight of the mail piece as received from the scale 40, utilizing one or more rating tables that can be stored in a memory 54. Alternatively, if rating tables are stored within the scale 40, the scale 40 could provide the postage costs for a mail piece to the control unit 20. Control unit 20 will generate an indicium, based on the determined postage cost, for printing on the mail piece by printer 52 as the mail piece is transported past the printer 52. Alternatively, control unit 20 can activate the tape drive 56 to deliver a tape to the printer 52, and the printer 52 will print the indicium on the tape for adhering to a mail piece.

As previously noted, when the mailing machine 10 is being operated in a differential weighing mode, a plurality of mail pieces are placed on the platter 42 of scale 40 and the collective weight of the mail pieces is registered. When the user removes a mail piece from the platter 42, the difference between the original collective weight of the mail pieces and the new collective weight of the mail pieces remaining on the platter 42 of the scale 40 is determined. The cost for shipping of the mail piece is calculated based on the determined differential weight. Since each mail piece must be removed from a stack of mail pieces previously placed on the platter 42 and placed on the feed deck 30, efficient operation of the mailing machine 10 is dependent upon the user. As the user will typically attempt to operate the mailing machine 10 as quickly as possible to achieve the greatest throughput, it is possible for errors to occur with respect to weighing and feeding of the mail pieces.

Figure 3A:
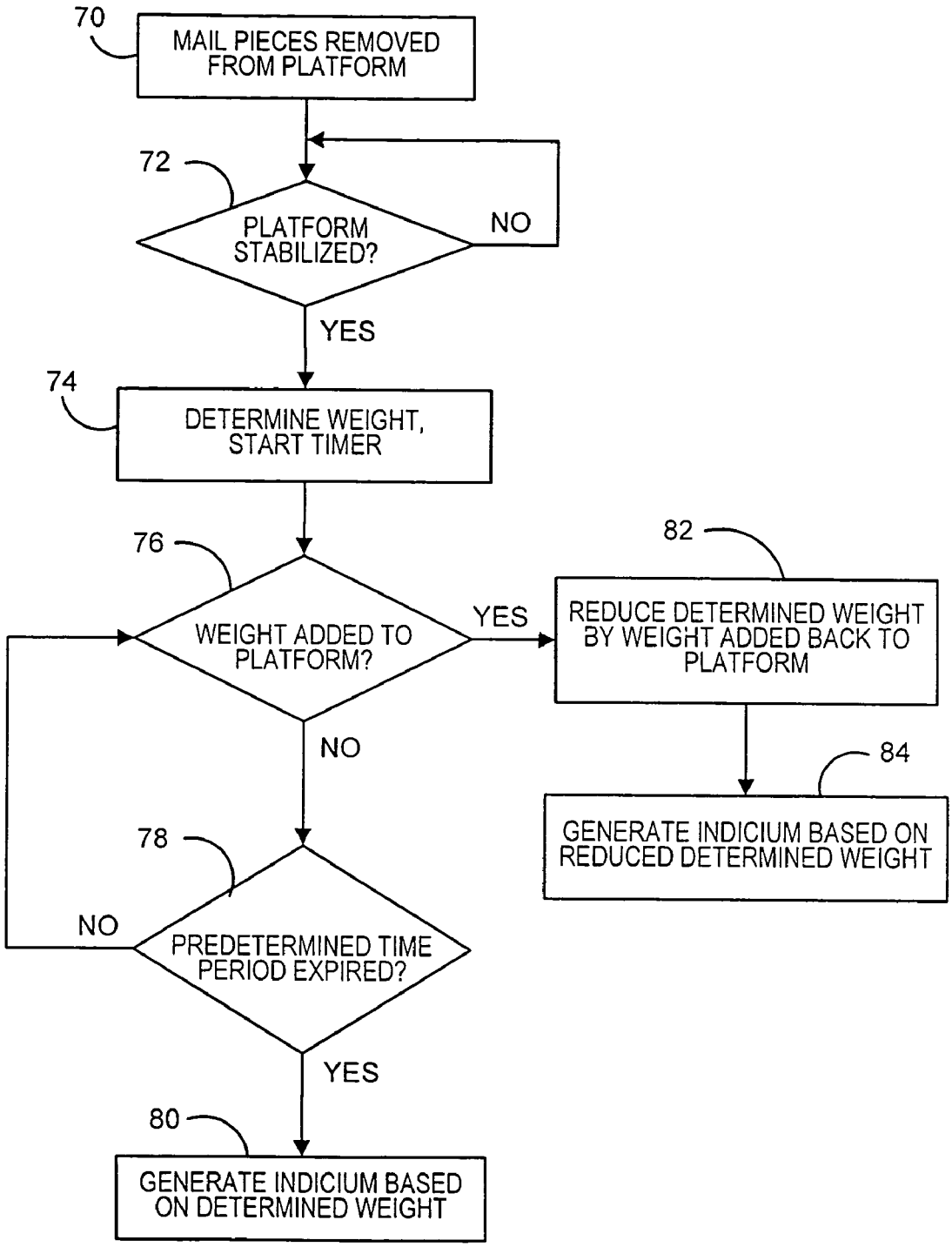
FIGS. 3A and 3B illustrate in flow diagram form the processing performed by mailing machine 10 according to embodiments of the present invention.

One such error occurs when the user inadvertently removes more than one mail piece from the platter 42 at the same time. When this occurs, a single weight will be determined based on the combined weight of the removed mail pieces, and therefore an indicium for an incorrect postage amount (which will be greater than necessary, thereby costing the user additional unnecessary postage fees), based on the weight of all removed mail pieces, will be generated by the mailing machine 10. In some instances, the user, realizing that more than one mail piece was removed from the scale 40 at the same time, may attempt to correct the error by replacing the mail pieces improperly removed, such that only a single piece has now actually been removed. According to embodiments of the present invention, the mailing machine 10 will detect if the user has replaced a mail piece back onto the platform 42 of scale 40 and perform the necessary processing to ensure that the correct weight based only on the actual mail piece intended to be removed is determined. The processing performed by mailing machine 10 according to one embodiment is illustrated in flow diagram form in FIG. 3A. In step 70, the user removes one or more mail pieces from the platform 42 of the scale 40. In step 72, it is determined if the platform 42 has sufficiently stabilized such that the differential weight can be determined. It should be noted that depending upon the weighing algorithm being utilized, it may not be necessary for the platform 42 to be completely stable before a weight can be determined, and instead the platform 42 may just need to sufficiently stabilize such that a reasonably accurate weight reading can be obtained. If the platform has not sufficiently stabilized, then the processing will continue to loop until the platform has sufficiently stabilized. Once the platform has sufficiently stabilized, then in step 74 the weight of the removed mail piece(s) is determined and a timer is started. The timer could be implemented by software within control unit 20 (or within scale 40), by hardware, or a combination. In step 76, it is determined if weight has been added back to the platform 42 of the scale 40. Such a determination is made if the weight on the platform 42 increases. For example, if the user has only removed one mail piece from the platform 42, then the user will not replace any mail pieces back on to the platform. If the user has removed more than one mail piece, the user may not immediately realize the error and thus not replace any mail pieces inadvertently removed.

If no weight has been added back to the platform 42, then in step 78 it is determined if a predetermined time period, as indicated by the timer started in step 74, has expired. Such a predetermined time period could be, for example, 2 seconds. It should be understood, of course, that the predetermined time period can be any number based on the desired throughput of the mailing machine 10 and is merely a design choice. Preferably, the predetermined time period can be user adjustable to accommodate the desires of the user. If the predetermined time period has not expired in step 78, then the processing will loop back to step 76 and continue monitoring to determine if any weight has been added to the platform 42. Once the predetermined time period has expired, then in step 80 the control unit 20 will generate an indicium based on the weight determined in step 74. This time period can be made user configurable to balance throughput with accuracy. It could also be made applicable to only an auto-tape mode (where each indicium is printed on a piece of tape or label).

If, however, at any point before the predetermined time period has expired it is determined in step 76 that weight has been added back to the platform 42, then in step 82 the weight determined in step 74 will be reduced by the weight added back to the platform 42. For example, suppose the user has removed two mail pieces, the first one having a weight of 0.9 ounces and the second one having a weight of 0.6 ounces. The weight, as determined in step 74, will be 1.5 ounces (the sum of both mail pieces). The user, upon realizing the mistake, replaces the second one of the removed mail pieces, weighing 0.6 ounces, back onto the scale. In step 82, the weight determined in step 74 of 1.5 ounces will be reduced by 0.6 ounces, to provide a reduced determined weight of 0.9 ounces. In step 84, the control unit 20 will generate an indicium based on the reduced determined weight. Accordingly, the indicium for the first mail piece will be generated based on only the weight of the first mail piece, and therefore the correct amount of postage will be applied to the first mail piece. Thus, the mailing machine 10 will detect if the user has replaced a mail piece back onto the platform 42 of scale 40 and perform the necessary processing to ensure that the correct weight based only on the actual mail piece intended to be removed is determined. Optionally, when operating in an envelope mode (where each indicium is printed on an envelope), detection of a mail piece on the feed deck 30 by the sensors 34 could serve as confirmation that the user has removed the desired number of mail pieces and the determined weight should be utilized to generate an indicium. Thus, when the user places a mail piece on the feed deck 30, the processing will not continue until the predetermined time period has expired and instead will go directly to step 80 to generate an indicium based on the determined weight.

Figure 3B:
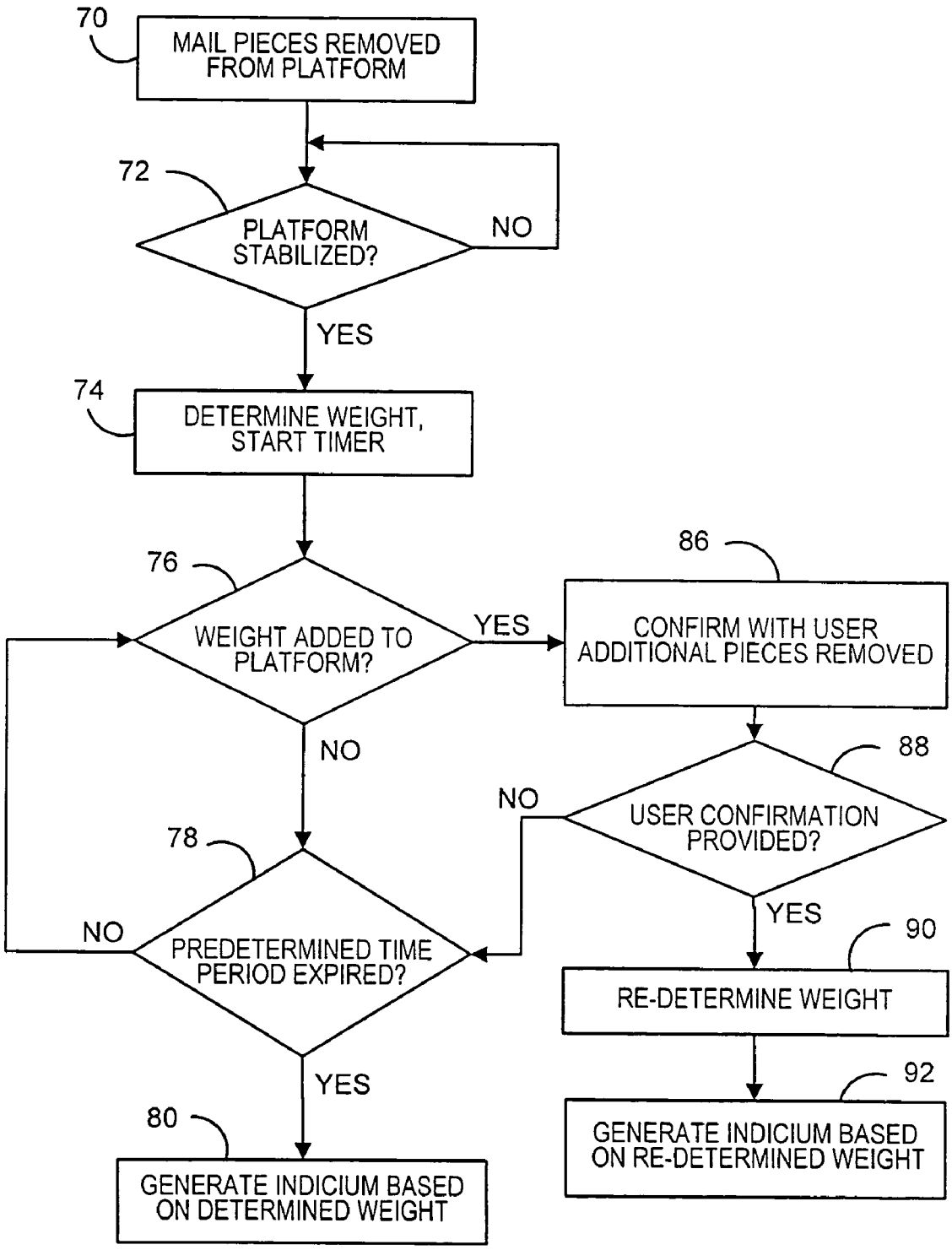

The processing performed by mailing machine 10 according to another embodiment of the present invention is illustrated in flow diagram form in FIG. 3B. In FIG. 3B, steps 70-80 are similar as described above with respect to FIG. 3A and therefore will not be repeated. According to the embodiment illustrated in FIG. 3B, if at any point before the predetermined time period has expired it is determined in step 76 that weight has been added back to the platform 42, then in step 86 the user will be asked to confirm that more than one mail piece was removed from the platform 42 and the user is attempting to correct this error by replacing the incorrectly removed mail piece(s) back onto the platform 42. For example, the control unit 20 can display a message to the user on the display 24, and the user can confirm utilizing the keyboard 22. In step 88 it is determined if the user has provided confirmation. If in step 88 the user has indicated that there was not more than one mail piece removed and the user is not trying to correct the error, then the processing will continue to steps 76 and 78 to monitor the platform 42 for added weight until the predetermined time period has expired. Such a situation could be caused, for example, by the user inadvertently bumping the platform 42. If in step 88 the user confirms that more than one mail piece was removed and the user has replaced one or more mail pieces back onto the platform 42, then in step 90 the weight of the removed mail piece is re-determined, and in step 92, the control unit 20 will generate an indicium based on the re-determined weight. Accordingly, the indicium will be generated based on only the weight of the single mail piece not replaced back onto the platform 42 by the user, and therefore the correct amount of postage will be applied to that mail piece. Thus, the mailing machine 10 will detect if the user has replaced a mail piece (or pieces) back onto the platform 42 of scale 40 and perform the necessary processing to ensure that the correct weight based only on the actual mail piece intended to be removed is determined.

In other instances, the user will not realize that more than one mail piece was removed from the scale 40 at the same time and simply place the removed mail pieces on the feed deck 30 of the mailing machine 10. The generated indicium with the incorrect postage will be printed on only one of the mail pieces that is processed by the mailing machine 10, and the other pieces will remain on the feed deck 30. The scale 40 will not provide another signal to the control unit 20, as it has already provided the signal to the control unit 20 (based on the weight of the already removed mail pieces) and the weight on the platter 42 has not changed (as no further mail pieces have been removed).

Figure 4:
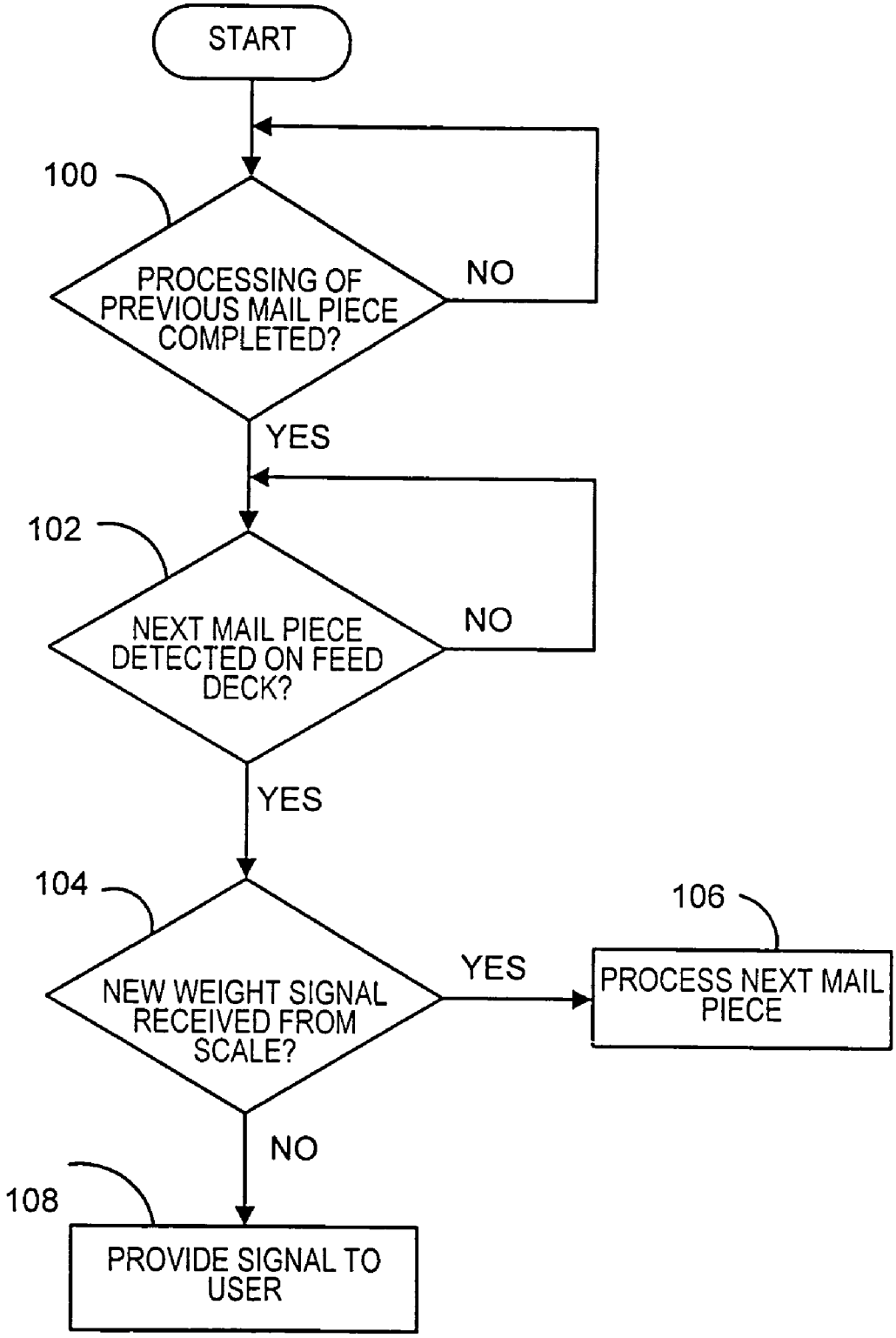
FIG. 4 illustrates in flow diagram form the processing performed by mailing machine 10 according to an embodiment of the present invention.

According to embodiments of the present invention, if the user does not attempt to correct the mistake by replacing the inadvertently removed mail pieces back onto the platform 42 of the scale 40, the mailing machine 10 will detect the presence of the inadvertently removed mail pieces on the feed deck 30 and inform the user of the error. The processing performed by mailing machine 10 according to this embodiment is illustrated in flow diagram form in FIG. 4. The operation as illustrated in FIG. 4 is preferably performed and controlled by control unit 20. In step 100, it is determined if processing, i.e., generation and printing of an indicium, for a previous mail piece has been completed by the mailing machine 10. If processing for a previous mail piece has not been completed, then the processing will continue to loop until a mail piece has been completely processed by the mailing machine 10. Once a mail piece has been completely processed, then in step 102 it is determined if a next mail piece is detected on the feed deck 30 by the sensors 34. If a next mail piece has not been detected on the feed deck 30, the processing will continue to loop until a next mail piece is detected. Once a next mail piece has been detected on the feed deck 30, it is determined in step 104 if the control unit 20 has received a new weight signal from the scale 40 for the next mail piece. If the control unit 20 has received a new weight signal from the scale 40, then in step 106 the next mail piece will be processed by the mailing machine using the new weight signal received from the scale 40. If, however, the control unit 20 has not received a new weight signal from the scale 40, as would occur if the user removed more than one mail piece at the same time and placed all of the removed mail pieces on the feed deck 30, in step 108 control unit 20 will provide a signal to the user to indicate to the user that the mail piece on the feed deck 30 has not been weighed and must therefore be placed back on the platform 42 of the scale 40. Such a signal could be a visual message displayed on the display 24 of control unit 20, or alternatively could be an audio signal emitted by speaker 58. Preferably, the signal is a visual message on the display 24, and also preferably notifies the user that the mail piece that has just been processed may have been imprinted with too much postage, as the postage costs were calculated based on the combined weight of all of the removed mail pieces. Thus, according to this embodiment, the mailing machine 10 makes the user aware of the problem, i.e., that the mail piece on the feed deck 30 has not been weighed, and also that the mail piece that has just been processed may have been imprinted with too much postage, instead of remaining idle as previous conventional mailing machines. The user, therefore, will not make any assumptions with respect to the operating status of the mailing machine 10, e.g., restart the entire system, which is time consuming, thereby decreasing the throughput of the mailing machine, or place a service call in the belief that the mailing machine 10 is in need of repair.

Another error that can occur with respect to weighing and feeding of the mail pieces is if the user removes subsequent mail pieces too quickly from the platform 42, such that the platform 42 did not have sufficient time to stabilize and determine the weight of the mail piece previously removed before a subsequent mail piece is removed. In this situation, it is possible that the determined weight for a single mail piece will be the sum of both of the removed mail pieces. According to an embodiment of the present invention, mailing machine 10 is be provided with means to provide a visual or audible signal to the user indicating when the next mail piece can be removed from the platter 42. Such a visual signal could be provided by the display 24, and such an audio signal could be provided by the speaker 58 coupled to the control unit 20. This will help to ensure that the user does not remove the mail pieces too quickly. In some instances, the platform 42 will take an unusually long amount of time to stabilize, due to, for example, a very heavy mail piece, or large vibration or mechanical noise imposed on the mailing machine 10 from external or internal sources. According to an embodiment of the present invention, if the platform does not stabilize within a predetermined time period, a visual or audible signal is provided to the user indicating that the platform 42 has not stabilized within an expected time frame, thereby alerting the user that there may be a problem with the scale 40 or mailing machine 10. Such a visual signal could be provided by the display 24, and such an audio signal could be provided by the speaker 58 coupled to the control unit 20. If an audio signal is provided, it is preferably different than the signal provided when a next mail piece can be removed from the platter 42 as described above. Thus, for example, if the normal time for the platform 42 to stabilize is approximately 1 second, and the platform 42 has not stabilized within 1.75 seconds, control unit 20 will cause a visual or audible signal to be provided to the user indicating that the platform 42 has not stabilized, thereby alerting the user to a possible problem and that corrective action should be taken to ensure proper weighing and processing of mail pieces. The predetermined time period can be user adjustable to accommodate the desires of the user. An optimal time period for the predetermined time period can also be automatically calculated and adjusted utilizing historical tracking and averaging during the course of operation of the mailing machine 10.

While preferred embodiments of the invention have been described and illustrated above, it should be understood that these are exemplary of the invention and are not to be considered as limiting. Additions, deletions, substitutions, and other modifications can be made without departing from the spirit or scope of the present invention. Accordingly, the invention is not to be considered as limited by the foregoing description but is only limited by the scope of the appended claims.

What is claimed is:

1. In a mailing system including a scale adapted to weigh mail pieces in a differential mode, a method for processing mail pieces comprising:

determining a first weight for at least one mail piece that has been removed from the scale;

determining if weight has been added back to the scale within a first predetermined time period after the first weight for the at least one mail piece has been determined;

if weight has not been added back to the scale within the first predetermined time period, determining a first carrier shipping charge based on the first weight; and, if weight has been added back to the scale within the first predetermined time period, determining a second weight for the at least one removed mail piece utilizing the weight added back to the scale and determining a second carrier shipping charge based on the second weight.

2. The method of claim 1, wherein determining the second weight further comprises:

reducing the first weight by the weight added back to the scale.

3. The method of claim 1, wherein determining the second weight further comprises:

requesting confirmation from a user that weight was added back to the scale;

determining that the scale has sufficiently stabilized to obtain the second weight after confirmation is received from the user; and determining the second weight after the scale has sufficiently stabilized.

4. The method of claim 3, wherein requesting confirmation from the user further comprises:

displaying a visual message to the user requesting confirmation that weight was added back to the scale.

5. The method of claim 1, wherein determining the first carrier shipping charge further comprises:

requesting confirmation from a user that weight was added back to the scale;

determining that the user has not provided confirmation that weight was added back to the scale;

determining that the first predetermined time period has expired;

determining that weight has not been added back to the scale; and determining the first carrier shipping charge based on the first weight.

6. The method of claim 1, wherein after the first or second weight for the at least one mail piece that has been removed from the scale has been determined, the method further comprises:

determining that the scale has sufficiently stabilized to obtain a next weight; and providing a signal to a user indicating that the scale has sufficiently stabilized and a next mail piece can be removed from the scale.

7. The method of claim 6, wherein the signal includes an audible signal.

8. The method of claim 6, wherein the signal includes a visual signal.

9. The method of claim 1, wherein determining the first weight for at least one mail piece that has been removed from the scale further comprises:

determining that the scale has sufficiently stabilized to determine the first weight for the at least one mail piece that has been removed from the scale, when the scale has sufficiently stabilized within a second predetermined time period; and providing a signal to a user indicating that the scale has not sufficiently stabilized, when the scale has not sufficiently stabilized within the second predetermined time period.

10. The method of claim 9, wherein the signal includes an audible signal.

11. The method of claim 9, wherein the signal includes a visual signal.

12. The method of claim 1, further comprising:

printing a generated indicium on a first mail piece;

determining that a second mail piece is located on a feed deck of the mailing system;

determining if a corresponding weight for the second mail piece has been received from the scale;

if the corresponding weight for the second mail piece has been received, processing the second mail piece utilizing the corresponding weight; and if the corresponding weight for the second mail piece has not been received, providing a signal to a user to indicate that the second mail piece has not been weighed.

13. The method of claim 12, wherein the signal is a message that instructs the user to place the second mail piece onto the scale.

14. The method of claim 13, wherein the message further includes a notice to the user that the generated indicium printed on the first mail piece may be incorrect.

15. The method of claim 1, further comprising:

generating an indicium using the first carrier shipping charge if the second carrier shipping charge is not determined, or using the second carrier shipping charge if the second carrier shipping charge is determined; and printing the generated indicium on one of the at least one mail piece that has been removed from the scale.

16. A mailing system for processing mail pieces comprising:

a scale adapted to operate in a differential weighing mode; and a control unit coupled to the scale, the control unit being adapted to: determine a first weight for at least one mail piece removed from the scale; determine if weight has been added back to the scale within a first predetermined time period after the first weight for the at least one mail piece has been determined; if weight has not been added back to the scale within the first predetermined time period, determine a first carrier shipping charge based on the first weight; and, if weight has been added back to the scale within the first predetermined time period, determine a second weight for the at least one removed mail piece utilizing the weight added back to the scale and determine a second carrier shipping charge based on the second weight.

17. The mailing system according to claim 16, wherein the second weight is determined by reducing the first weight by the weight added back to the scale.

18. The mailing system according to claim 16, further comprising:

a display unit coupled to the control unit, wherein, if weight has been added back to the scale within the first predetermined time period, the control unit displays a message to a user requesting confirmation that weight was added back to the scale.

19. The mailing system according to claim 16, further comprising:

a speaker coupled to the control unit, wherein the control unit is further adapted to provide an audible signal via the speaker to a user after the scale has sufficiently stabilized to determine the first weight for the at least one mail piece that has been removed from the scale.

20. The mailing system according to claim 16, further comprising:

a speaker coupled to the control unit, wherein the control unit is further adapted to: determine that the scale has not sufficiently stabilized, within a second predetermined time period, to determine the first weight for the at least one mail piece that has been removed from the scale; and provide an audible signal via the speaker to a user.

21. The mailing system according to claim 16, further comprising:

a feed deck having an input end; and at least one sensor located at the input end of the feed deck to detect a mail piece placed on the feed deck, wherein the control unit is further adapted to: determine that the mail piece placed on the feed deck is located on the feed deck of the mailing system; determine if a corresponding weight for the mail piece placed on the feed deck has been received from the scale; if the corresponding weight for the mail piece placed on the feed deck has been received, process the mail piece placed on the feed deck utilizing the corresponding weight; and, if the corresponding weight for the mail piece placed on the feed deck has not been received, provide a signal to a user to indicate that the mail piece placed on the feed deck has not been weighed.

* * * * *